US006237909B1

(12) United States Patent
Carter, Jr. et al.

(10) Patent No.: US 6,237,909 B1
(45) Date of Patent: May 29, 2001

(54) CONSTANT NORMAL FORCE SHEET MATERIAL FEED MECHANISM

(75) Inventors: Scott K. Carter, Jr., Holzgerlingen (DE); Laurent A. Regimbal, Eagle, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/421,923

(22) Filed: Oct. 20, 1999

(51) Int. Cl.[7] ..... B65H 3/06
(52) U.S. Cl. ..... 271/110; 271/117
(58) Field of Search ..... 271/110, 117, 271/118, 152

(56) References Cited

U.S. PATENT DOCUMENTS

| | | | | |
|---|---|---|---|---|
| 4,084,807 | * | 4/1978 | Terajima et al. | 271/118 |
| 4,934,686 | * | 6/1990 | Ono et al. | 271/118 |
| 5,927,703 | * | 7/1999 | Endo | 271/117 |

FOREIGN PATENT DOCUMENTS

| | | | | |
|---|---|---|---|---|
| 404223939 | * | 8/1992 | (JP) | 271/117 |
| 405000743 | * | 1/1993 | (JP) | 271/110 |
| 405000744 | * | 1/1993 | (JP) | 271/110 |

* cited by examiner

*Primary Examiner*—H. Grant Skaggs

(57) ABSTRACT

A sheet material feed mechanism including a sheet material transport mechanism mounted for contact with a stack of sheet material is disclosed. A force application mechanism is adapted and constructed to apply a variable normal force to the stack of sheet material through the sheet material transport mechanism. A displacable force detection assembly is mounted between the sheet material transport mechanism and the force application mechanism. Displacement of the force detection assembly corresponds to a normal force applied to the stack of sheet material through the sheet material transport mechanism. The sheet material transport mechanism can be provided as a feed roller assembly. The feed roller assembly can include a driven roller in contact with the stack of sheet material. A drive roller can be operatively connected to the driven roller and the force application mechanism. The force detection assembly can be provided as a motion-sensing device. The motion-sensing device can include a spring member having first and second ends, the first end of the spring member being secured to the force application mechanism. A sensor can be secured to the force application mechanism, with a sensor flag secured to the second end of the spring member. A normal force applied to the stack of sheet material through the sheet material transport mechanism causes a distance between the sensor flag and the sensor to vary. The sheet material feed roller mechanism can include a control system.

20 Claims, 2 Drawing Sheets

CONSTANT NORMAL FORCE SHEET MATERIAL FEED MECHANISM

FIELD OF THE INVENTION

The present invention relates to sheet material feed mechanisms. More specifically, the present invention relates to torque loading of sheet material feed rollers associated with imaging devices such as printers, copiers, and fax machines.

BACKGROUND OF THE INVENTION

Imaging systems such as printers, fax machines, and copiers are virtually omnipresent, and can be found in homes and offices worldwide. The development of such systems has facilitated improvements in communication that have in turn fostered a sea of change in the way people live and work. Telecommuting, paperless offices, and intra-office networks represent but a few examples of the advancements that have been made possible by modern imaging systems.

Since these systems have become crucial to everyday existence, their reliability and smooth operation is paramount. It is therefore vitally important to design imaging systems so that downtime and work interruptions are minimized. This can be a daunting challenge, given the relative complexity of systems in which sheet material must be infed, moved through the imaging process, and outfed in a matter of seconds.

It has been found that the difference in weight between smaller and larger sheet sizes, differences in weight between thicker and thinner sheets, and different sheet surface textures can present problems in sheet feeding throughout the imaging system. For each combination of these factors, successful transportation of sheet material depends upon applying the proper amount of applied force on the sheet with a feed mechanism such as a roller. The combination of forces is shown in FIG. 1. When torque T is applied to the roller R, the combination of torque and normal force N produces a transport force P, which causes the sheet material to move. Accurate application of the applied force A transmitted through the roller R allows the system designer to produce the desired normal and transport forces appropriate for a particular sheet material.

The consequences of incorrect forces can be problematic. Using the infeed mechanism as an example, if the applied force is too low, sheets can have "no-pick" problems, where the transport force is insufficient to remove the sheets from the stack. At the other end of the spectrum, if the force is too great, the result may be "multi-feed" problems, wherein the transport force introduces several sheets into the feed mechanism simultaneously. Excess force can also cause deformation of one or more of the underlying sheets.

Among the known approaches to address these difficulties are systems which rely upon a method of sensing the height of a stack of sheet media, then placing the transport mechanism based on the sensed height of the media stack. Such systems are relatively complex, and do not directly control the normal force applied to the media stack when the pick mechanism operates. Further, known devices employ multiple sensing devices, one to sense stack height and another to sense transport mechanism position.

It can thus be seen that the need exists for a reliable and predictable way to transmit applied force to a feed roller associated with imaging devices such as printers, copiers, and fax machines.

SUMMARY OF THE INVENTION

These and other objects are achieved by providing a sheet material feed mechanism including a sheet material transport mechanism mounted for contact with a stack of sheet material. A force application mechanism is adapted and constructed to apply a variable normal force to the stack of sheet material through the sheet material transport mechanism. A displacable force detection assembly is mounted between the sheet material transport mechanism and the force application mechanism. Displacement of the force detection assembly corresponds to a normal force applied to the stack of sheet material through the sheet material transport mechanism.

The sheet material transport mechanism can be provided as a feed roller assembly. The feed roller assembly can include a driven roller in contact with the stack of sheet material. A drive roller can be operatively connected to the driven roller and the force application mechanism.

The force detection assembly can be provided as a motion-sensing device. The motion-sensing device can include a spring member having first and second ends, the first end of the spring member being secured to the force application mechanism. A sensor can be secured to the force application mechanism, with a sensor flag secured to the second end of the spring member. A normal force applied to the stack of sheet material through the sheet material transport mechanism causes a distance between the sensor flag and the sensor to vary.

The sheet material feed roller mechanism can include a control system adapted and constructed to monitor and control the sheet material feed roller mechanism. A connector assembly operatively connects the force detection assembly to the control system. The force application mechanism can be provided as a stepper motor.

The features of the invention believed to be patentable are set forth with particularity in the appended claims. The invention itself, however, both as to organization and method of operation, together with further objects and advantages thereof, may be best understood by reference to the following description taken in conjunction with the accompanying drawings.

DETAILED DESCRIPTION OF THE INVENTION

Figure 1:
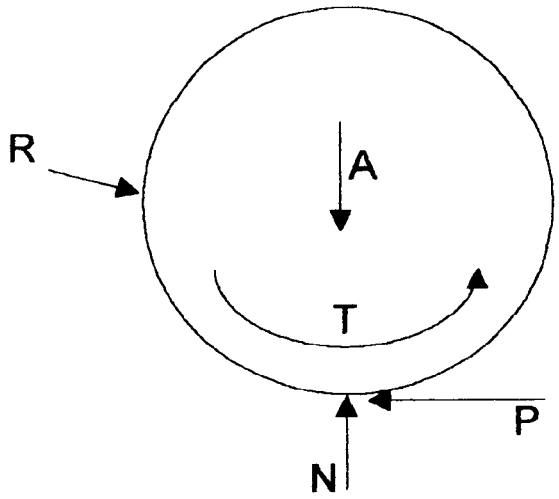
FIG. 1 is a schematic illustration of the forces acting on a feed roller, as described in the Background of the Invention.
Figure 2:
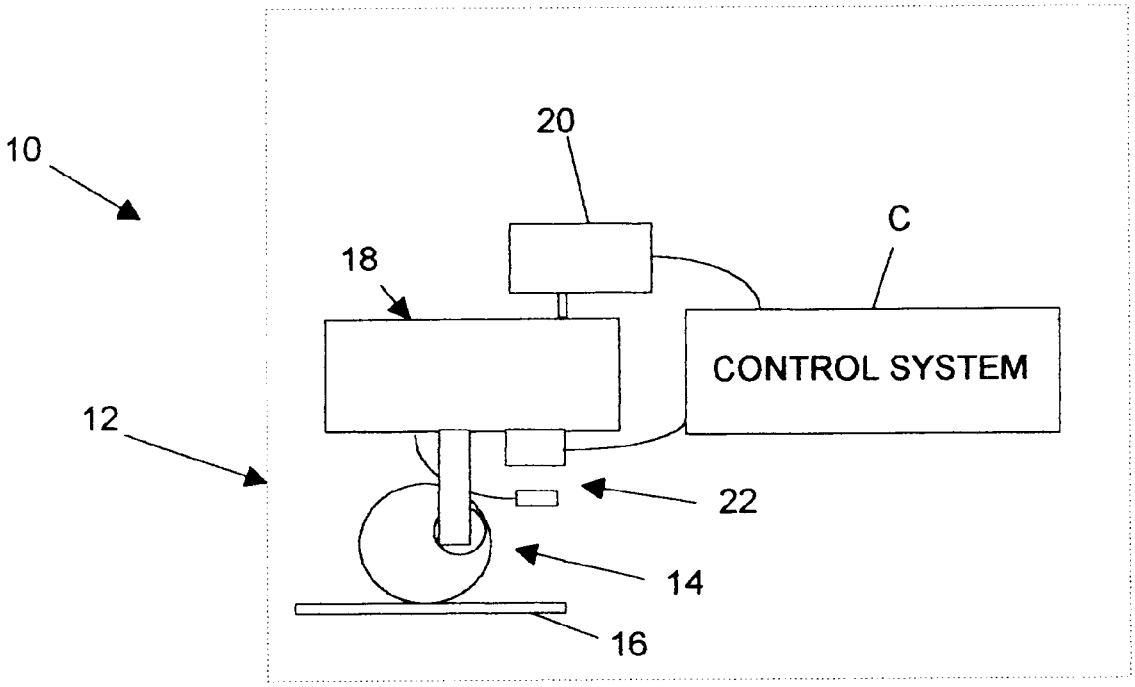
FIG. 2 is a schematic illustration of a sheet material feed mechanism in accordance with the principles of the present invention.

A sheet material feed mechanism 10 in accordance with the principles of the present invention is shown in FIG. 2. The feed mechanism 10 can be provided in association with an imaging system 12, such as a printer, copier, or fax machine. The feed mechanism 10 includes a sheet material transport mechanism 14 mounted for contact with a stack of sheet material 16 that is to be transported through the imaging system 12. The sheet material 16 can be any sheet material suitable for use in imaging devices, such as paper, card stock, or plastic transparency material.

A force application mechanism 18 is provided that is adapted and constructed to cause the sheet material transport mechanism 14 to apply a variable normal force to the sheet material 16. The force application mechanism 18 can be provided as any suitable electronically controllable motor, such a stepper motor or a DC motor. A computer-controlled variable power source 20 can be connected to the force application mechanism 18.

A displacable force detection assembly 22 is mounted between the sheet material transport mechanism 14 and the force application mechanism 18. As the force application mechanism 18 applies a normal force to the stack of sheet material 16 through the sheet material transport mechanism 14, the force detection assembly 22 is displaced. The amount of displacement of the force detection assembly 22 corresponds to the amount of normal force applied to the stack of sheet material 16. A control system C, which may reside in the firmware of the imaging system 12, receives feed back from the force detection assembly 22 and controls the force application mechanism 18 accordingly.

Figure 3:
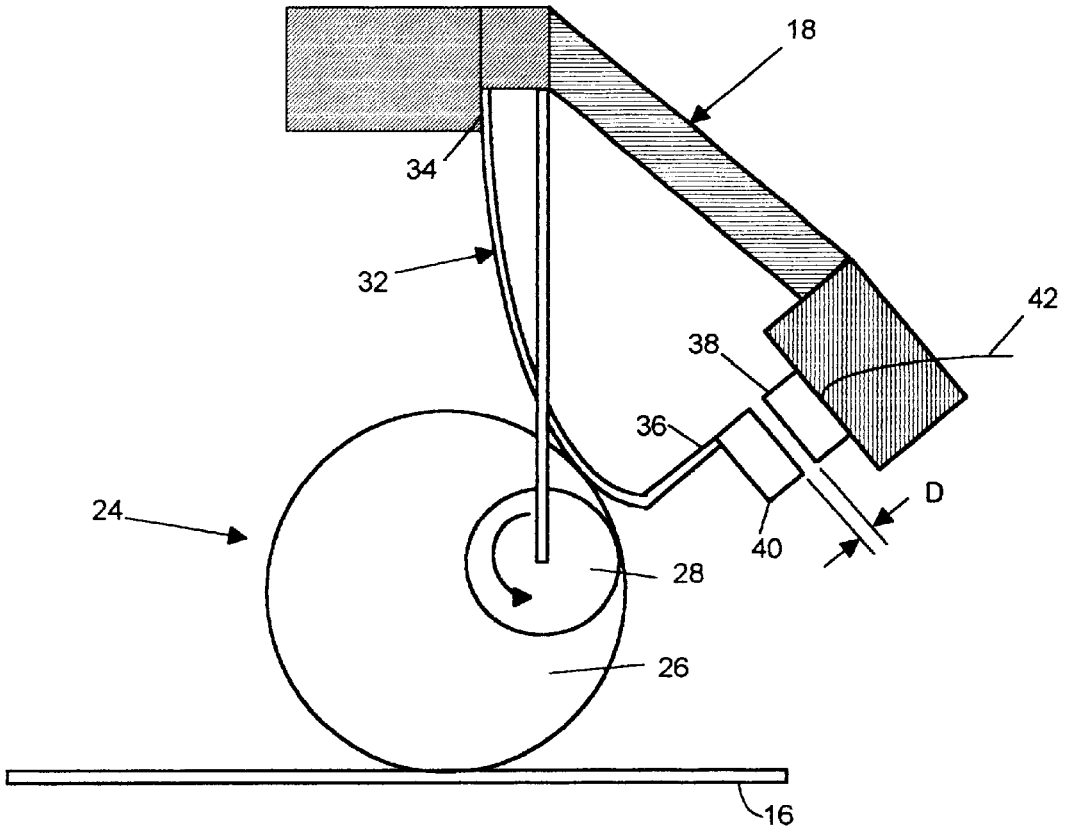
FIG. 3 is a schematic illustration of an embodiment of a sheet material feed mechanism including torque loading of a roller.

A more detailed exemplary embodiment of the sheet material feed mechanism 10 is shown in FIG. 3. Here, the sheet material transport mechanism 14 is provided as a feed roller assembly 24. The feed roller assembly 24 includes a driven roller 26 in contact with the stack of sheet material 16. A drive roller 28 is operatively connected to the driven roller 26 and to the force application mechanism 18. The drive roller 28 as shown is mounted for movement with the force application mechanism 18 while remaining in driving engagement with the driven roller 26.

The force detection assembly 22 is provided as a motion-sensing device 30. The motion-sensing device 30 includes a spring member 32 having a first end 34 and a second end 36. The first end 34 of the spring member 32 is secured to the force application mechanism 18. A sensor 38 is secured to the force application mechanism 18, and a sensor flag 40 is secured to the second end 36 of the spring member. When the force application mechanism 18 applies a normal force to the stack of sheet 16 material through the sheet material transport mechanism 14, the spring member 32 is deflected by contact with the driven roller 26. Deflection of the spring member 32 causes the distance D between the sensor flag 40 and the sensor 38 to vary. This distance is converted to an electrical signal by the sensor 38, which signal is communicated to the control system C through a connector assembly 42 operatively connecting the force detection assembly 22 to the control system C. The sensor and sensor flag can be of any suitable type.

The deflection of the spring member 32 is directly related to the normal force applied to the stack of sheet material 16 by the following relationship:

$N=kd$ where:

N normal force applied to the stack of sheet material;

k=spring constant of the spring member; and d=distance of deflection of the spring member.

Thus, the normal force applied to the stack of sheet material 16 can be held at a constant value independent of paper height variation, manufacturing tolerances associated with separate paper height sensors, and roller wear.

A key advantage of the present invention is that of reduced complexity of manufacture, particularly with respect to the transport mechanism. The present invention eliminates the need for a separate paper height sensing assembly, since it combines the function of a paper height sensor and transport force sensor in a single sensing mechanism. The present invention is easily integrated into existing imaging device architecture without significant modification. It is contemplated that mechanisms constructed in accordance with the present invention will physically fit in mounting apparatus now employed in known imaging systems and/or associated devices, such as the HP 3000-Sheet Stapler/Stacker.

Although the present invention has been described with reference to specific embodiments, those of skill in the art will recognize that changes may be made thereto without departing from the scope and spirit of the invention as defined by the appended claims.

What is claimed is:

1. A sheet material feed mechanism comprising the following:

a sheet material transport mechanism mounted for contact with a stack of sheet material;

a force application mechanism adapted and constructed to apply a variable normal force to the stack of sheet material through the sheet material transport mechanism; and a displacable force detection assembly mounted between the sheet material transport mechanism and the force application mechanism, whereby displacement of the force detection assembly corresponds to a normal force applied to the stack of sheet material through the sheet material transport mechanism.

2. A sheet material feed mechanism according to claim 1, wherein the sheet material transport mechanism comprises a feed roller assembly.

3. A sheet material feed mechanism according to claim 1, wherein the feed roller assembly comprises the following:

a driven roller in contact with the stack of sheet material; and a drive roller operatively connected to the driven roller and the force application mechanism.

4. A sheet material feed mechanism according to claim 1, wherein the force detection assembly comprises a motion-sensing device.

5. A sheet material feed mechanism according to claim 4, wherein the motion-sensing device comprises the following:

a spring member having first and second ends, the first end of the spring member being secured to the force application mechanism;

a sensor secured to the force application mechanism; and a sensor flag secured to the second end of the spring member;

whereby a normal force applied to the stack of sheet material through the sheet material transport mechanism causes a distance between the sensor flag and the sensor to vary.

6. A sheet material feed roller mechanism according to claim 1, further comprising the following:

a control system adapted and constructed to monitor and control the sheet material transport mechanism; and a connector assembly operatively connecting the force detection assembly to the control system.

7. A sheet material feed roller mechanism according to claim 1, wherein the force application mechanism comprises a stepper motor.

8. In an imaging system including a stack of sheet material adapted to be fed through the system, a sheet material feed mechanism comprising the following:

a sheet material transport mechanism mounted for contact with the stack of sheet material;

a force application mechanism adapted and constructed to apply a variable normal force to an upper surface of the stack of sheet material through the sheet material transport mechanism; and a displacable force detection assembly mounted between the sheet material transport mechanism and the force application mechanism, whereby displacement of the force detection assembly corresponds to a normal force applied to the stack of sheet material through the sheet material transport mechanism.

9. A sheet material feed mechanism according to claim 8, wherein the sheet material transport mechanism comprises a feed roller assembly.

10. A sheet material feed mechanism according to claim 8, wherein the feed roller assembly comprises the following:

a driven roller in contact with the stack of sheet material; and a drive roller operatively connected to the driven roller and the force application mechanism.

11. A sheet material feed mechanism according to claim 8, wherein the force detection assembly comprises a motion-sensing device.

12. A sheet material feed mechanism according to claim 11, wherein the motion-sensing device comprises the following:

a spring member having first and second ends, the first end of the spring member being secured to the force application mechanism;

a sensor secured to the force application mechanism; and a sensor flag secured to the second end of the spring member;

whereby a normal force applied to the stack of sheet material through the sheet material transport mechanism causes a distance between the sensor flag and the sensor to vary.

13. A sheet material feed roller mechanism according to claim 8, further comprising the following:

a control system adapted and constructed to monitor and control the sheet material transport mechanism; and a connector assembly operatively connecting the force detection assembly to the control system.

14. A sheet material feed mechanism according to claim 13, wherein the imaging system comprises firmware, and the control system is located in the imaging system firmware.

15. A sheet material feed roller mechanism according to claim 8, wherein the force application mechanism comprises a stepper motor.

16. In a sheet material feed mechanism associated with an imaging system, a method of controlling normal forces applied by the sheet feed mechanism, the method comprising the following steps:

providing a sheet material transport mechanism mounted for contact with a stack of sheet material;

providing a force application mechanism adapted and constructed to apply a variable normal force to the stack of sheet material through the sheet material transport mechanism;

providing a displacable force detection assembly mounted between the sheet material transport mechanism and the force application mechanism;

displacing the force detection assembly by applying a normal force to the stack of sheet material through the sheet material transport mechanism; and sensing the amount of displacement of the force detection assembly.

17. A method according to claim 16, wherein the step of providing a sheet material transport mechanism comprises providing a feed roller assembly comprising the following:

a driven roller in contact with the stack of sheet material; and a drive roller operatively connected to the driven roller and the force application mechanism.

18. A method according to claim 16, wherein the step of providing a force detection assembly comprises providing a motion-sensing device comprising the following:

a spring member having first and second ends, the first end of the spring member being secured to the force application mechanism;

a sensor secured to the force application mechanism; and a sensor flag secured to the second end of the spring member;

whereby a normal force applied to the stack of sheet material through the sheet material transport mechanism causes a distance between the sensor flag and the sensor to vary.

19. A method according to claim 16, further comprising the following steps:

providing a control system adapted and constructed to monitor and control the sheet material feed roller mechanism; and operatively connecting the force detection assembly to the control system.

20. A method according to claim 16, wherein the step of providing a force application mechanism comprises providing a stepper motor.

* * * * *